US011381031B2

(12) United States Patent
Ando

(10) Patent No.: US 11,381,031 B2
(45) Date of Patent: Jul. 5, 2022

(54) CONNECTOR HAVING A TERMINAL FIXED TO A HOUSING

(71) Applicant: SUMITOMO WIRING SYSTEMS, LTD., Yokkaichi (JP)

(72) Inventor: Motohiro Ando, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/757,674

(22) PCT Filed: Oct. 24, 2018

(86) PCT No.: PCT/JP2018/039438

§ 371 (c)(1),
(2) Date: Apr. 20, 2020

(87) PCT Pub. No.: WO2019/087886

PCT Pub. Date: May 9, 2019

(65) Prior Publication Data

US 2020/0274290 A1 Aug. 27, 2020

(30) Foreign Application Priority Data

Oct. 31, 2017 (JP) ..... JP2017-210020

(51) Int. Cl.
*H01R 13/533* (2006.01)
*H01R 13/405* (2006.01)

(52) U.S. Cl.
CPC ..... *H01R 13/533* (2013.01); *H01R 13/405* (2013.01); *H01R 2201/26* (2013.01)

(58) Field of Classification Search
CPC .... H01R 13/40; H01R 13/405; H01R 13/533; H01R 2201/26; H01R 24/66; H01R 43/16; H01R 43/24
USPC ..... 439/849–859, 868
See application file for complete search history.

(56) References Cited

U.S. PATENT DOCUMENTS 3,437,983 A * 4/1969 Gilissen ..... H01R 9/2608 439/716
6,024,585 A * 2/2000 Mickievicz ..... H01Q 7/00 343/702
6,315,611 B1 * 11/2001 Sawada ..... H01R 33/09 439/619

(Continued)

FOREIGN PATENT DOCUMENTS

JP 2001-110499 A 4/2001
JP 2005-353354 A 12/2005

(Continued)

OTHER PUBLICATIONS

Jan. 8, 2019 Search Report issued in International Patent Application No. PCT/JP2018/039438.

*Primary Examiner* — Renee S Luebke
*Assistant Examiner* — Milagros Jeancharles
(74) *Attorney, Agent, or Firm* — Oliff PLC

(57) ABSTRACT

A connector, including a terminal; and a housing to which the terminal is fixed, wherein the terminal includes: a plate-like first connection; a holder projecting in one direction intersecting the first connection from a side edge of the first connection; and a second connection projecting in the one direction from a side edge of the first connection and facing the holder, the holder and the second connection being fixed in the housing.

3 Claims, 6 Drawing Sheets

(56) References Cited

U.S. PATENT DOCUMENTS

| | | | | |
|---|---|---|---|---|
| 6,905,348 | B2 * | 6/2005 | Naitou | H01R 9/2458 439/76.2 |
| 9,136,641 | B2 * | 9/2015 | Bishop | H01R 13/62 |
| 2014/0030932 | A1 | 1/2014 | Lee | |

FOREIGN PATENT DOCUMENTS

| | | | |
|---|---|---|---|
| JP | 2015-211533 | A | 11/2015 |
| JP | 2017-152111 | A | 8/2017 |

* cited by examiner

CONNECTOR HAVING A TERMINAL FIXED TO A HOUSING

BACKGROUND

A technique disclosed by this specification relates to a connector.

A joint connector described in Japanese Unexamined Patent Publication No. 2013-82256 is known as an example of a conventional connector. This joint connector includes a conductive plate, a plate-like reinforcing member and a housing.

The conductive plate is plate-like and includes a ground terminal provided on one end side and a terminal connecting portion provided on the other end side. The reinforcing member is plate-like and includes a body-side reinforcing portion provided on one end side and a housing-side reinforcing portion provided on the other end side.

The housing includes a receptacle open forward, and a mating connector is fit into the receptacle. A part of the terminal connecting portion of the conductive plate and a part of the housing-side reinforcing portion of the reinforcing member are embedded in a back wall of the receptacle by insert molding. A bolt is inserted through the ground terminal of the conductive plate and the body-side reinforcing portion, and fixed to a vehicle side.

SUMMARY

However, there has been a problem that stress is applied to boundary surfaces of the conductive plate and the reinforcing member with the back wall of the receptacle and the housing is broken if vibration from the vehicle is applied to the ground terminal and a bolt fixing portion.

A connector disclosed in this specification is a connector with a terminal, and a housing to which the terminal is fixed, wherein the terminal includes a plate-like first connection, a holder projecting in one direction intersecting the first connection from a side edge of the first connection, and a second connection projecting in the one direction from a side edge of the first connection and facing the holder, the holder and the second connection being fixed in the housing.

Since the terminal is fixed at two points, i.e. at the holder and the second connection, in the housing, breakage in a boundary surface of the housing with the terminal can be prevented as compared to the case where the terminal is fixed at one point as before since a load applied to the boundary surface of the housing with the terminal is distributed to two points.

Further, since the terminal is fixed at two points, i.e. at the holder and the second connection in the housing, the terminal having a lower linear expansion coefficient than the housing suppresses a dimensional variation of the housing even if the housing thermally expands or contracts to cause the dimensional variation. In this way, the dimensional variation of the housing due to thermal expansion or contraction can be suppressed.

Further, the holder may include a first base end projecting in the one direction from the side edge of the first connection, and a holding piece projecting in the one direction from the first base end and longer in a width direction than the first base end.

Since the holding piece of the holder is longer in the width direction than the first base end, even if the holder fixed in the housing is going to come out from the housing, the holder is caught in the housing. In this way, the holder is prevented from coming out from the housing.

Further, the second connection may include a second base end projecting in the one direction from the side edge of the first connection, and a hollow cylinder projecting in the one direction from the second base end.

By providing the second connection with the second base end and the hollow cylinder, the second base end can be fixed in the housing, the outer surface of the hollow cylinder can be exposed from the housing and the hollow cylinder can serve as a contact portion with a mating terminal.

According to the connector disclosed in this specification, it is possible to prevent breakage occurring in the boundary surface between the terminal and the housing.

DETAILED DESCRIPTION OF EMBODIMENTS

Embodiment

An embodiment is described with reference to FIGS. 1 to 6.

Figure 3:
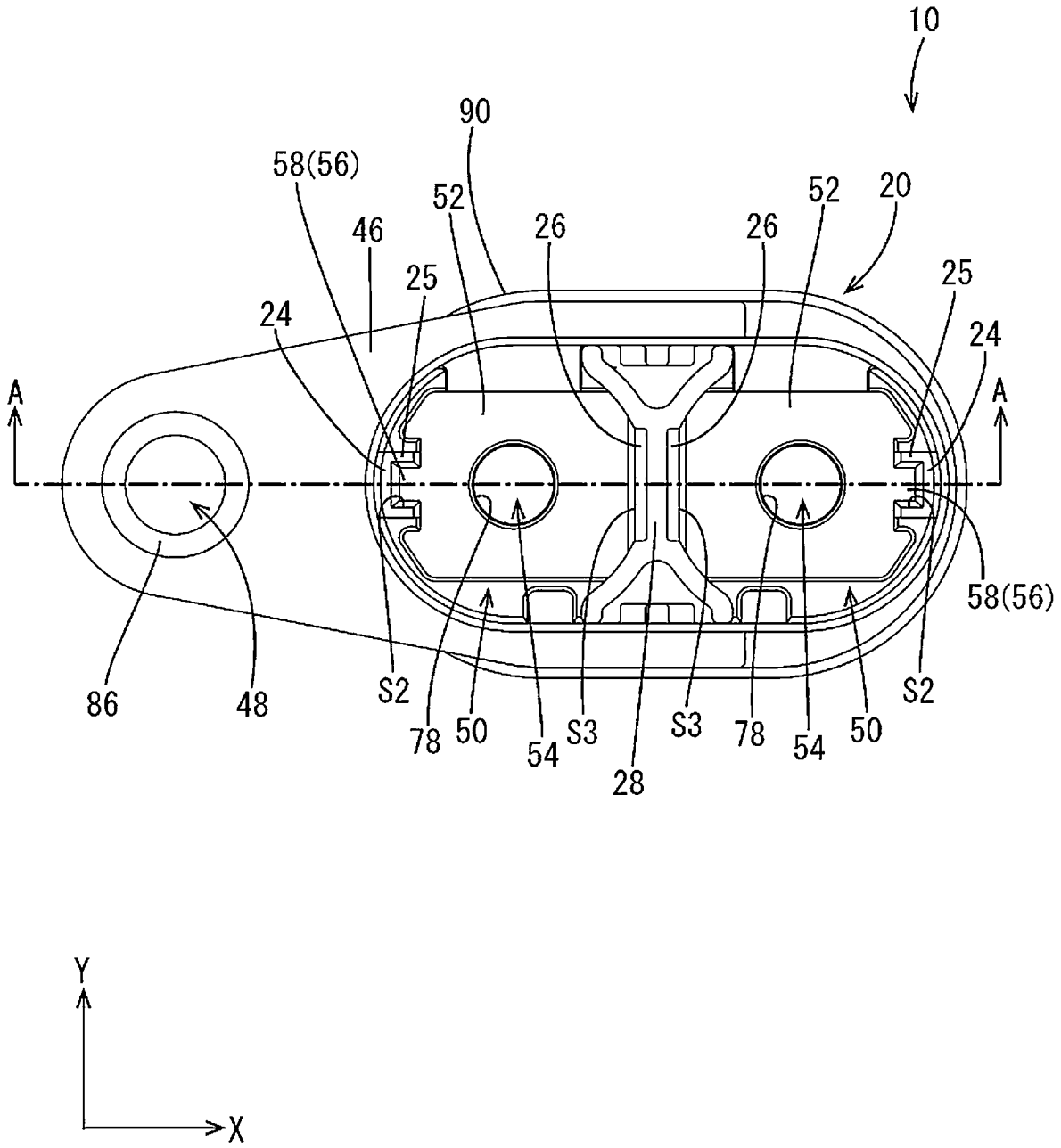
FIG. 3 is a back view of the connector.
Figure 4:
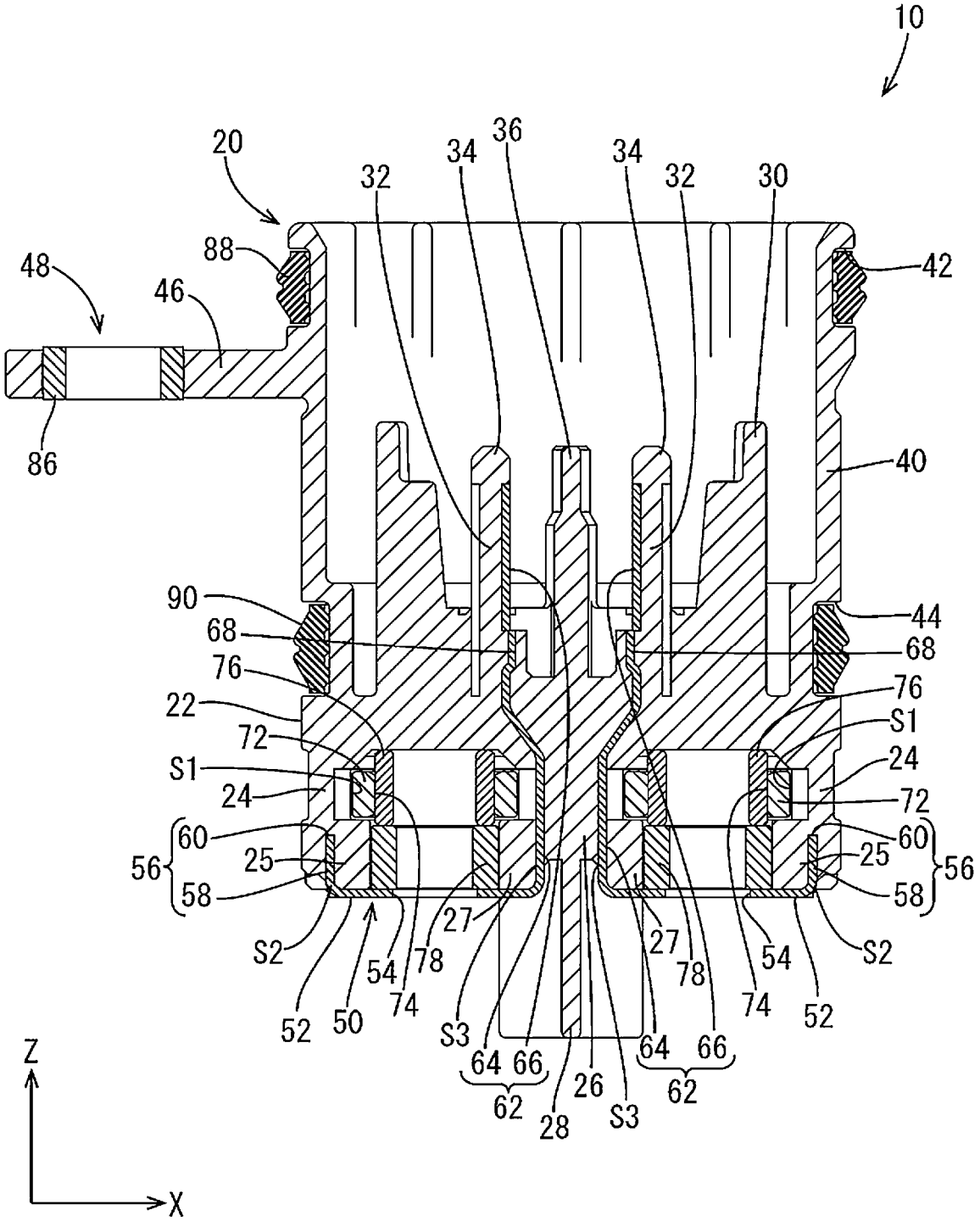
FIG. 4 is a section along A-A in FIG. 3.

A connector 10 of this embodiment is a connector linking a battery of a vehicle and a PCU (Power Control Unit) and includes, as shown in FIG. 4, a housing 20 and two terminals 50 fixed to the housing 20 by insert molding. In the following description, a Z direction and an X direction of FIGS. 1 and 4 are referred to as an upward direction and a rightward direction, and a Y direction of FIGS. 2 and 3 is referred to as a forward direction.

Figure 1:
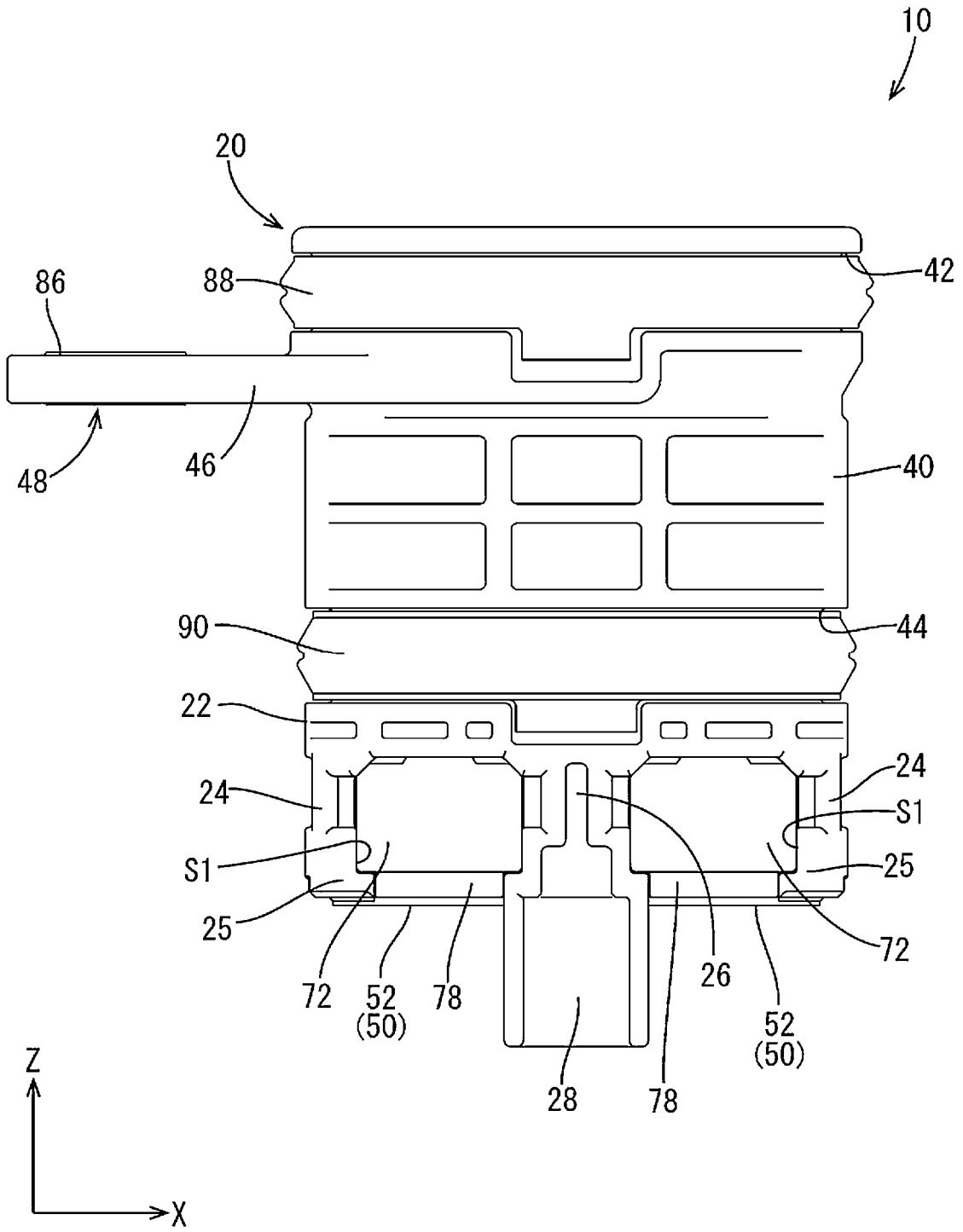
FIG. 1 is a front view of a connector of an embodiment.
Figure 2:
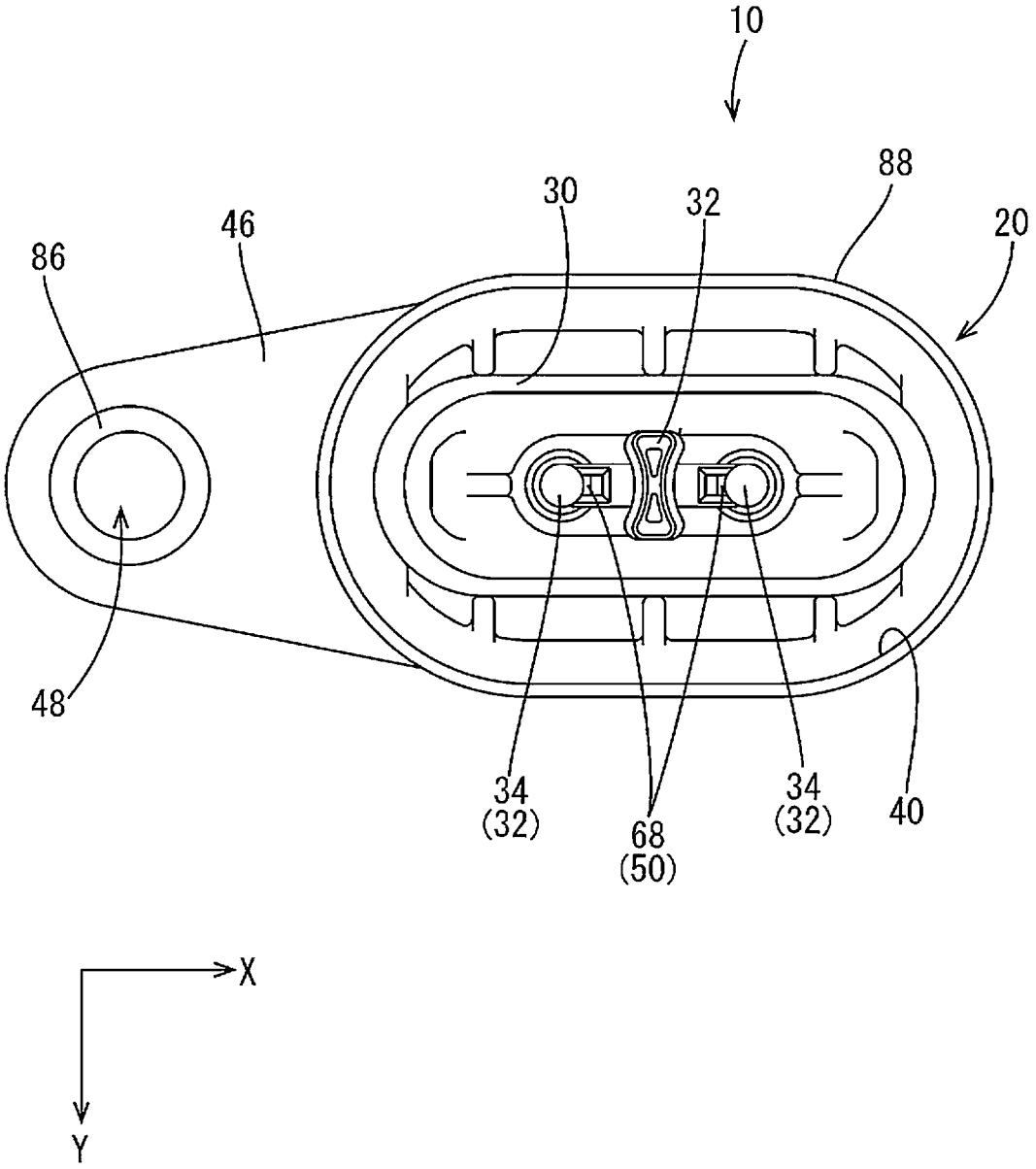
FIG. 2 is a plan view of the connector.

As shown in FIGS. 1, 2 and 4, the housing 20 includes a cylindrical base portion 22 elliptical in a plan view, and a receptacle 40 open upward from the base portion 22. An unillustrated mating connector is fit into the receptacle 40 from above.

A pair of first terminal fixing portions 24 project downward from side edges on both sides of the base portion 22, and a pair of first pedestal portions 25 project toward the different terminal fixing portions 24 from lower ends of the pair of first terminal fixing portions 24. Lower ends of the pair of first pedestal portions 25 are located below the lower ends of the pair of first terminal fixing portions 24. Further, a second terminal fixing portion 26 projects downward from a central part of the base portion 22 and a pair of second pedestal portions 27 project toward the pair of first terminal fixing portions 24. Lower ends of the pair of second pedestal portions 27 are located below a lower end of the second terminal fixing portion 26. Further, a first partition wall 28 projects downward from the lower end of the second terminal fixing portion 26. The pair of first terminal fixing portions 24 and the second terminal fixing portion 26 face each other, and spaces between facing surfaces of the pair of first terminal fixing portions 24 and the second terminal fixing portion 26 serve as accommodation spaces S1 capable of accommodating cases 72 to be described later as shown in FIGS. 1 and 4.

As shown in FIG. 4, an inner tube portion 30 projects upward from the base portion 22. As shown in FIG. 2, the inner tube portion 30 is in the form of a tube elliptical in a plan view and disposed inside the receptacle 40. The upper end position of the inner tube portion 30 is located below that of the receptacle 40 as shown in FIG. 4.

As shown in FIG. 4, a pair of first projecting portions 32 project upward from the base portion 22. The pair of first projecting portions 32 are in the form of bars and disposed at a predetermined distance from each other in the inner tube portion 30. Tip parts 34 having round tips are provided to project upward on upper end parts of the first projecting portions 32. An outer diameter of a lower end of the tip part 34 is larger than that of the first projecting portion 32, and the first projecting portion 32 and the tip part 34 are coaxially disposed.

As shown in FIG. 4, a second partition wall 36 projects upward from an upper end part of the base portion 22, and disposed between the pair of first projecting portions 32. The second partition wall 36 functions as an insulation wall for insulating between the pair of terminals 50 to be described later. The positions of front end parts of the first projecting portions 32 and the second partition wall 36 are located below an upper end opening edge of the inner tube portion 30.

Grooves are provided respectively on upper and lower sides of the outer peripheral surface of the receptacle 40, wherein the upper groove serves as a first groove portion 42 and the lower groove serves as a second groove portion 44. A first rubber ring 88 is fit in the first groove portion 42, and a second rubber ring 90 is fit in the second groove portion 44.

As shown in FIGS. 1 to 4, a plate-like second projecting portion 46 projects leftward from the outer peripheral surface of the receptacle 40. As shown in FIG. 4, the second projecting portion 46 is provided between the first and second groove portions 42, 44. A fastening hole 48 is open in the second projecting portion 46, and a hollow cylindrical first collar 86 is mounted in the fastening hole 48. Although not shown, a bolt is inserted through the first collar 86 and fixed to a mating member.

Figure 5:
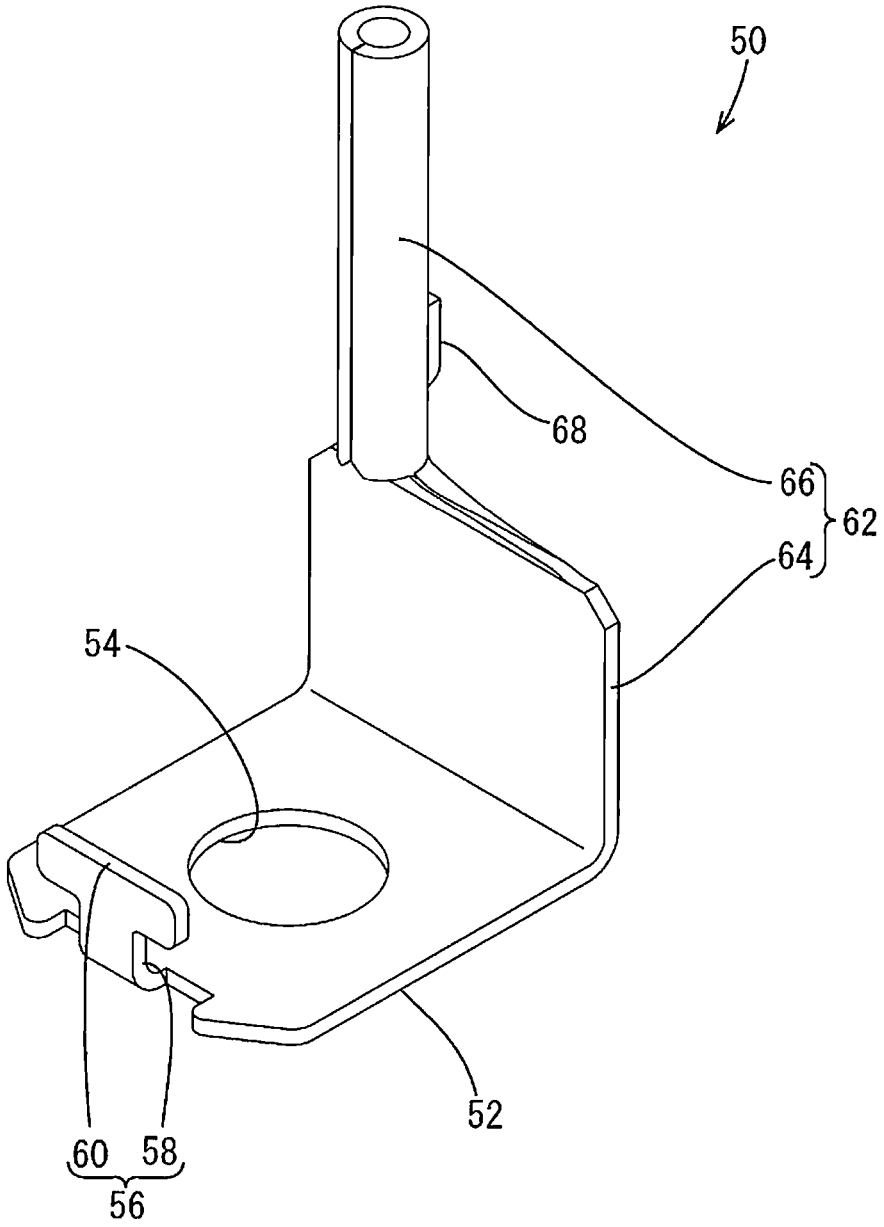
FIG. 5 is a plan view of a terminal.

As shown in FIG. 5, the terminal 50 is formed by press-working and bending a thin copper plate and includes a first connecting portion 52 (first connector), a holding portion 56 (holder) and a second connecting portion 62 (second connector) to be connected to a mating terminal.

The first connecting portion 52 is in the form of a rectangular plate and a fastening hole 54 to which a bolt can be fastened is open in the first connecting portion 52. As shown in FIG. 4, the first connecting portion 52 is in contact with the lower surfaces of the pair of first pedestal portions 25 and the lower surfaces of the second pedestal portions 27.

Figure 6:
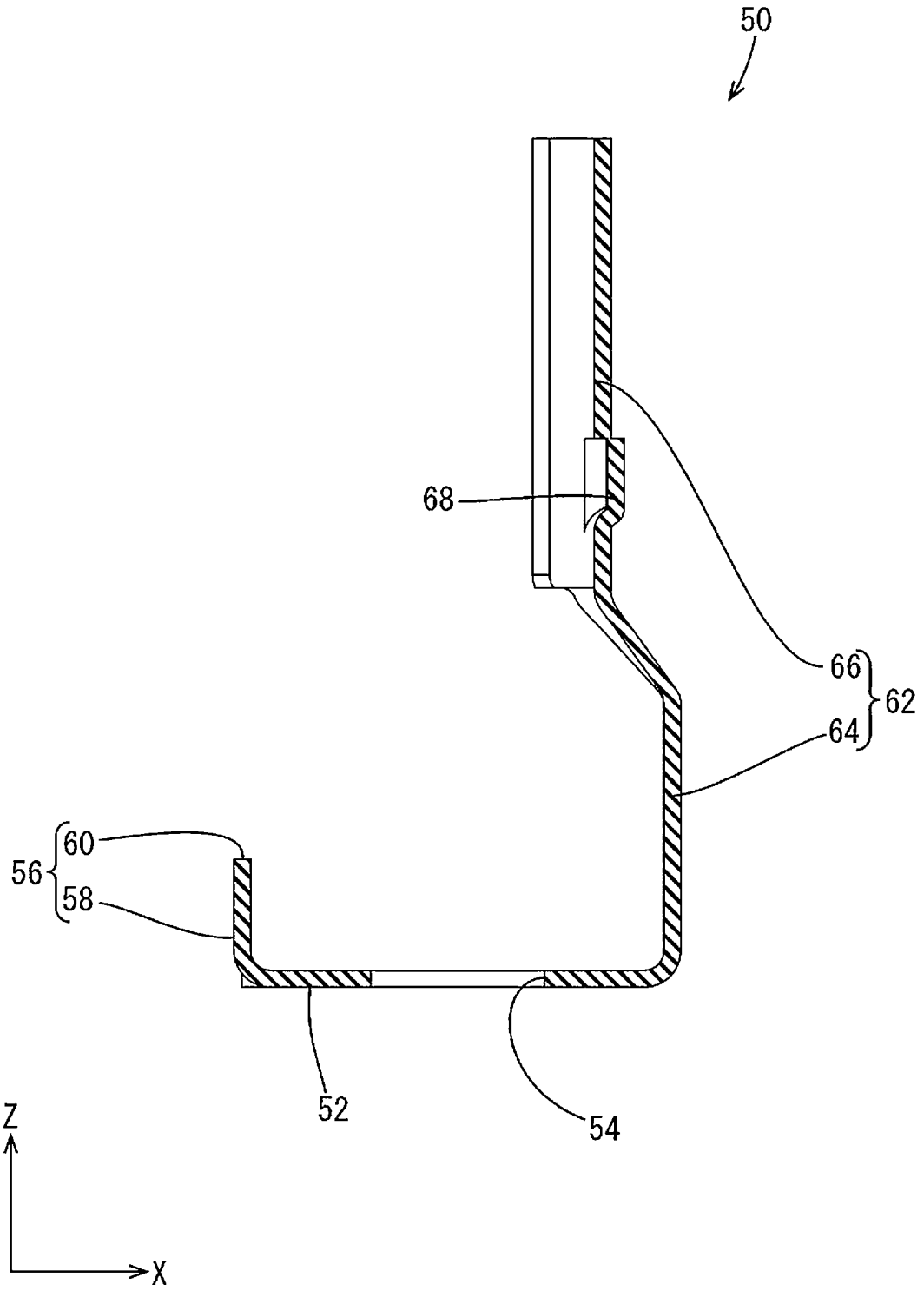
FIG. 6 is a section of the terminal.

As shown in FIGS. 4, 5 and 6, the holding portion 56 includes a plate-like first base end portion 58 (first base end) projecting upward from a side edge of the first connecting portion 52 and a plate-like holding piece 60 projecting upward from the first base end portion 58. The holding portion 56 of the terminal 50 is embedded in the first terminal fixing portion 24 of the housing 20 as shown in FIG. 4. Here, a boundary of the housing 20 with the holding portion 56 serves as a boundary surface S2.

A length in a width direction of the holding piece 60 is longer than that of the first base end portion 58 as shown in FIG. 5, whereby the terminal 50 is prevented from coming out from the first terminal fixing portion 24.

As shown in FIGS. 4 and 5, the second connecting portion 62 projects upward from a side edge of the first connecting portion 52 and includes a second base end portion 64 (second base end) located at a position facing the holding portion 56 and a hollow cylindrical portion 66 (hollow cylinder) projecting upward from the second base end portion 64. Here, an outer diameter of the hollow cylindrical portion 66 is about 3 mm. Further, a plate thickness of the terminal 50 is so set that resin can be filled into the hollow cylindrical portion 66 during insert molding while an outer diameter criterion of the hollow cylindrical portion 66 is satisfied.

As shown in FIG. 4, the hollow cylindrical portion 66 is provided with a positioning portion 68 cut and raised from the hollow cylindrical portion 66 toward the second partition wall 36 of the housing 20. The positioning portion 68 is used to position a mold during insert molding.

As shown in FIG. 4, the second connecting portion 62 is embedded in the housing 20 from the second base end portion 64 to an upper end part of the positioning portion 68. Here, a boundary of the housing 20 with the second connecting portion 62 serves as a boundary surface S3, which is located between the lower and upper ends of the second pedestal portion 27. Since the terminal 50 is fixed to the housing 20 at two points, i.e. at the holding portion 56 and the second connecting portion 62, via the boundary surfaces S2 and S3 in this way, the terminal 50 having a lower linear expansion coefficient than the housing 20 suppresses a dimensional variation of the housing 20 even if the housing 20 thermally expands or contracts to cause the dimensional variation. In this way, the dimensional variation of the housing 20 due to thermal expansion or contraction can be suppressed.

As shown in FIG. 4, a part of the hollow cylindrical portion 66 above the upper end part of the positioning portion 68 is exposed to outside, and the first projecting portion 32 of the housing 20 is located inside the hollow cylindrical portion 66. The hollow cylindrical portion 66 serves as a route for resin when the tip part 34 is formed. Further, an upper end of the hollow cylindrical portion 66 is in contact with a lower end of the tip part 34 of the housing 20. By the contact of the hollow cylindrical portion 66 with the mating terminal, the terminal 50 is electrically connected to the mating terminal. Since the tip part 34 of the housing 20 is provided on the upper end part of the hollow cylindrical portion 66, the contact of a user's finger or the like with the hollow cylindrical portion 66 is prevented when the finger or the like intrudes into the receptacle 40.

As shown in FIGS. 1 and 4, the case 72 is in the form of a box with an open lower wall, and a fixing hole 74 is open in an upper wall. A second collar 76 is accommodated in the fixing hole 74. Further, a nut 78 is accommodated between the second collar 76 and the terminal 50. An unillustrated bolt is inserted into the fastening hole 54 of the first connecting portion 52 of the terminal 50 and threadably engaged with the nut 78. The second collar 76 serves as an escaping hole for the bolt. As shown in FIG. 4, the lower surfaces of both side walls of the cases 72 can be in contact with the upper surfaces of the pair of first pedestal portions 25 and the upper surfaces of the pair of second pedestal portions 27, and downward displacements of the cases 72 accommodated in the accommodation spaces S1 of the housing 20 are restricted.

Next, functions of this embodiment are described.

The connector 10 is connected to the mating connector, and unillustrated mating round terminals are fixed to the first connecting portions 52 of the terminals 50 by the bolts. If vibration is applied to the connector 10 from the vehicle thereafter, a phase difference is generated between the vibration of the terminals 50 fixed to the mating round terminals and the vibration of the housing 20 connected to the mating connector, whereby a load is applied to the boundary surfaces S2 and S3. However, since each terminal 50 is fixed to the housing 20 at two positions via the boundary surfaces S2, S3, the load applied to the housing 20 is distributed to two points as compared to the case where a terminal is fixed to a housing at one point as before. Thus, the breakage of the housing 20 in the boundary surfaces S2, S3 between the terminal 50 and the housing 20 can be prevented. Further, by fixing the terminal 50 to the housing 20 at two points, the terminal 50 is integrated with the housing 20 and the terminal 50 is less likely to be broken by vibration as compared to the case where the terminal 50 is fixed at one point. Therefore, the breakage of the terminal 50 can be prevented even if the plate thickness of the terminal 50 is such a small thickness that the diameter of the hollow cylindrical portion 66 is about 3 mm and resin can pass into the hollow cylindrical portion 66.

As described above, according to this embodiment, since the terminal 50 is fixed at two points, i.e. at the holding portion 56 and the second connecting portion 62, in the housing 20, a load applied to the boundary surfaces S2, S3 of the housing 20 with the terminal 50 can be distributed to two points as compared to the case where a terminal is fixed at one point in a housing as before. Thus, breakage in the boundary surfaces S2, S3 of the housing 20 with the terminal 50 can be prevented.

Further, since the terminal 50 is fixed at two position, i.e. at the holding portion 56 and the second connecting portion 62, in the housing 20, even if the housing 20 thermally expands or contracts to cause a dimensional variation, the terminal 50 having a lower linear expansion coefficient than the housing 20 suppresses the dimensional variation of the housing 20. In this way, the dimensional variation of the housing 20 due to thermal expansion or contraction can be suppressed.

Further, since the holding piece 60 of the holding portion 56 is longer in the width direction than the first base end portion 58, even if the holding portion 56 fixed in the housing 20 is going to come out from the housing 20, the holding piece 60 is caught in the housing. In this way, the holding portion 56 is prevented from coming out from the housing 20.

By providing the second connecting portion 62 with the second base end portion 64 and the hollow cylindrical portion 66, the second base end portion 64 can be fixed in the housing 20, the outer surface of the hollow cylindrical portion 66 can be exposed from the housing 20 and the hollow cylindrical portion 66 can serve as a contact portion with the mating terminal.

Other Embodiments

The technique disclosed by this specification is not limited to the above described and illustrated embodiment. For example, the following various modes are also included.

(1) Although the first connecting portion 52 is in the form of a rectangular plate in the above embodiment, the shape of the first connecting portion 52 does not matter and may be in the form of a circular plate.

(2) Although the holding portion 56 and the second connecting portion 62 are embedded in the housing 20 and the terminal is fixed at two points in the housing 20 in the above embodiment, other holding portion(s) may be added to the terminal and the terminal may be fixed at three or more points in the housing 20.

(3) Although two terminals 50 are provided in the above embodiment, one, three or more terminals may be provided.

The invention claimed is:

1. A connector, comprising:
- a terminal; and
- a housing to which the terminal is fixed, wherein the terminal includes:
  - a plate-like first connection;
  - a holder projecting in one direction intersecting the first connection from a side edge of the first connection, and having a first boundary surface projecting in the one direction in the housing, the first boundary surface being formed between the housing and the holder; and
  - a second connection projecting in the one direction from a side edge of the first connection and facing the holder, and having a second boundary surface projecting in the one direction in the housing and facing the first boundary surface, the second boundary surface being formed between the housing the second connection,
- the holder and the second connection being fixed in the housing,
- the holder being fixed to the housing at the first boundary surface, and the second connection being fixed to the housing at the second boundary surface, and
- the second connection comprising a hollow cylinder, and a part of the housing is disposed inside the hollow cylinder.

2. The connector of claim 1, wherein the holder includes a first base end projecting in the one direction from the side edge of the first connection, and a holding piece projecting in the one direction from the first base end and longer in a width direction than the first base end.

3. The connector of claim 1, wherein the second connection includes a second base end projecting in the one direction from the side edge of the first connection, and the hollow cylinder projects in the one direction from the second base end.

* * * * *